US006095510A

United States Patent [19]

Jaeger

[11] Patent Number: 6,095,510

[45] **Date of Patent: *Aug. 1, 2000**

[54] METHOD FOR BINDING A PLURALITY OF GROUPS OF SHEETS

[75] Inventor: Erich Jaeger, Frauenfeld, Switzerland

[73] Assignee: Ferag AG, Hinwil, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 08/877,745

[22] Filed: Jun. 17, 1997

[30] Foreign Application Priority Data

Jun. 26, 1996 [CH] Switzerland ..... 1600/96

[51] Int. Cl.[7] ..... B42B 2/00

[52] U.S. Cl. ..... 270/52.18; 270/37; 412/6

[58] Field of Search ..... 270/58.07, 58.08, 270/52.18, 52.19, 52.26, 52.27, 37; 412/6

[56] References Cited

U.S. PATENT DOCUMENTS

| | | | |
|---|---|---|---|
| 680,554 | 8/1901 | Ward | 412/6 |
| 2,153,639 | 4/1939 | Palmer | 281/21 |
| 2,245,891 | 6/1941 | Ackley | 281/21 |
| 2,267,045 | 12/1941 | Russell | 281/25 |
| 2,314,087 | 3/1943 | Heller | 270/37 |
| 2,696,356 | 11/1954 | Hofferth | 270/52.18 |
| 4,106,148 | 8/1978 | Axelrod | 412/6 |
| 5,011,187 | 4/1991 | Hunder et al. | 412/6 |
| 5,085,551 | 2/1992 | Erdbories et al. | 412/6 |
| 5,507,524 | 4/1996 | Botschi et al. | 412/6 |

FOREIGN PATENT DOCUMENTS

| | | |
|---|---|---|
| 550501 | 9/1942 | United Kingdom . |

*Primary Examiner*—Christopher P. Ellis
*Assistant Examiner*—Patrick Mackey
*Attorney, Agent, or Firm*—Walter C. Farley

[57] ABSTRACT

A printed product (70) is produced from a plurality of product parts (71, 73, 75) consisting each of a plurality of sheets folded inside each other, by collating the folded product parts in a stack and by stitching the stack along a stitching line running parallel to the spine of the product with a distance from the spine chosen such that the innermost sheet of each product part is fixed by the stitching. Between the product parts (71, 73, 75) and/or on the outer sides of the stack of product parts, additional products (72, 74) and/or cover leafs or cover sheets may be added and fixed to the product parts with the same stitching.

9 Claims, 3 Drawing Sheets

30
31
32
33
3
31/32/33
50
51
41
42
43
40
11/12/13+21/22/23+31/32/33
20
21
22
23
21/22/23
11/12/13+21/22/23
10
11
12
13
11/12/13
11/12/13

METHOD FOR BINDING A PLURALITY OF GROUPS OF SHEETS

FIELD OF THE INVENTION

The invention concerns a method for producing printed products such as e.g. magazines or brochures substantially consisting of a plurality of folded sheets.

BACKGROUND OF THE INVENTION

Printed products which consist of a plurality of folded sheets are normally produced from an intermediate product or from a plurality of product parts, wherein the intermediate product or the product parts each consist of a plurality of sheets loosely folded inside each other. This kind of product part (tabloids) is e.g. produced by cutting a printed paper web lengthwise into a plurality of part-webs, by guiding the part-webs over each other and by cutting the superimposed part-webs transversely and folding the cut stacks of superimposed sheets substantially centrally between the cutting lines.

A finished product is produced from only one such intermediate product by connecting the sheets before or after cutting and before or after folding along the folding line e.g. with staples.

For producing finished products from a plurality of product parts as described above, the following methods are known:

The product parts are inserted inside each other ("from-outside-to-inside" method) or collected on top of each other ("from-inside-to-outside" method) and are stitched in their mutual folding line.

The product parts are inserted as above or collected or are stacked by collating in a folded state, the spine area then being milled off at least partly and the sheets being glued together in the milled areas.

The product parts are stitched individually, then collated and glued together in the spine area or connected by other means.

In all known methods, covers or cover sheets and/or spine covers can be applied to the collected product parts in varying manners.

SUMMARY OF THE INVENTION

An object of the invention is to provide a method for producing printed products from at least one product part, whereby the product part consists of a plurality of sheets folded inside each other as known from intaglio printing (tabloid). The method is easily carried out and is easily adaptable to varying product thicknesses and to varying formats and/or qualities of paper. All the same, the inventive method is to produce a printed product which is of a quality comparable to that of corresponding products produced with known methods and especially to have similarly good opening qualities. Furthermore the inventive method makes it easily possible to add to the product apart from the product parts as named before, further parts such as e.g. individual pages or smaller printed cards or sample bags etc. as well as to apply covers, cover sheets and/or spine covers.

According to the inventive method, the product parts consisting each of a plurality of sheets folded inside each other are collated to form a stack, wherein the folded edges of the product parts are positioned on top of each other. The stack is then stitched through all layers along a stitching line which stitching line runs parallel to the spine, whereby the distance between the stitching line and the outermost folded edge is sufficiently large for the innermost sheet of each product part to be fixed also by the stitching. In other words this means that the sheets of the product parts are stitched in a folded state and that the folded state of each sheet is fixed by the stitching. The product parts, which are produced in a folded state do not need to be opened for collating and for stitching, i.e. they do not need to be fitted with means for facilitating opening such as e.g. an off-center fold.

The stitching with which the collated product parts are connected is e.g. a multiple, e.g. a triple stapling (wire stitching) or a thread stitching over the whole length of the spine.

If only one product part (intermediate product) is to be processed into a finished product, there is no collating step. A product of the same kind as the one produced from only one intermediate product is also produced if instead of collating a plurality of product parts these are inserted inside each other or collected on top of each other and then stitched together in the manner described above. This kind of method is possible, but brings the disadvantage with it that with an increasing number of sheets folded inside each other the necessary distance between the stitching line and the spine is increased and thus a larger area of the pages cannot be printed on and the opening of the finished product is impaired more and more.

Before or after the stitching, a cover can be laid around the stack of product parts or a spine strip can be glued to the spine after stitching.

The advantages of the inventive method, compared with known methods which include gluing of a milled spine, are the facts that it is more independent of the quality of the paper to be processed, that it does not require drying or curing time, that it does not require energy for drying or curing purposes and that the product does not age. Furthermore the most various qualities of paper and/or differently coated papers can be processed together which would require different types of glue in a gluing method. Compared to known stitching methods in which the sheets folded inside each other are stitched in the fold line, the inventive method has the advantage that the sheets of different product parts must not be opened for stitching, that aligning and pressing the sheets for stitching is easier because the stitching does not take place in the fold line and that individual pages (not folded) can also be integrated into the product without problems. Compared to stitching in the fold line, the stack of paper to be stitched is double as thick which however is no problem for known stitching devices.

BRIEF DESCRIPTION OF THE DRAWINGS

Embodiments of the inventive method and embodiments of printed products producible with the inventive method are described in detail in connection with the following Figures, wherein.

DESCRIPTION OF PREFERRED EMBODIMENTS

Figure 1:
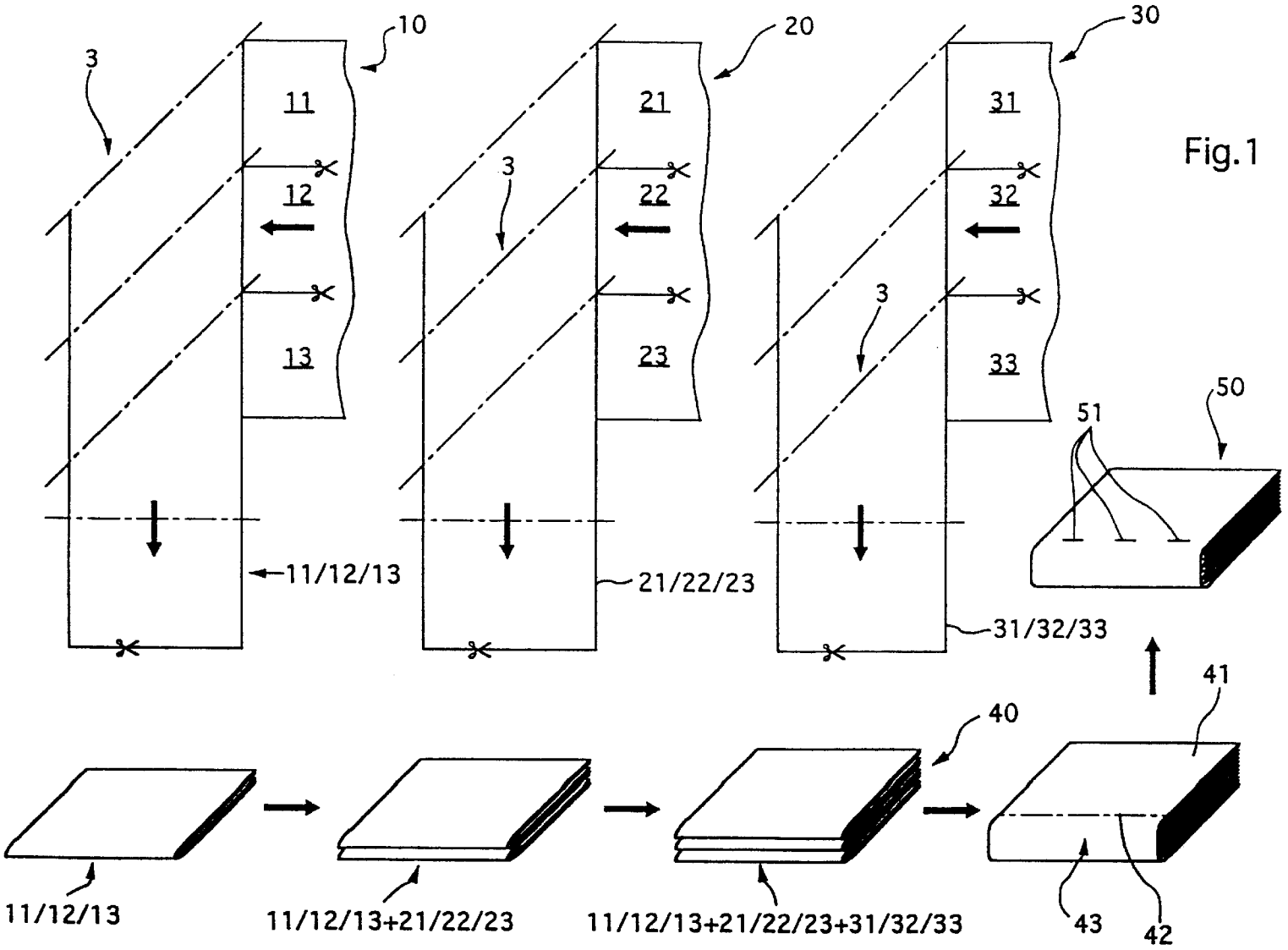
FIG. 1 is a schematic diagram of the steps of an embodiment of a variant of the inventive method for producing printed products which substantially consist of a plurality of folded sheets.

FIG. 1 diagrammatically shows an embodiment of the inventive method for producing printed products which substantially consist of a plurality of folded sheets.

Three product parts are e.g. produced from three printed paper webs 10, 20 and 30 in a manner known from intaglio printing which product parts each consist of three sheets folded inside each other, such representing twelve printed pages of the finished product. The product parts are produced by cutting the printed paper webs 10, 20 or 30 lengthwise (diagrammatically shown by two small scissors for each web), by guiding the part webs 11, 12 and 13 or 21, 22, 23 or 31, 32, 33 respectively produced by the longitudinal cutting over each other using turning bars 3, by cutting the superimposed webs transversely and by folding the groups of superimposed sheets (11/12/13, 21/22/23 and 31/32/33) formed by the transverse cutting transversely and substantially in their centers.

The product parts formed by transverse cutting and folding of the superimposed part webs are collated on a collating line to form a stack 40 (11/12/13+21/22/23+31/32/33). A cover sheet 41 (e.g. cover page) is laid around the stack 40 and then the stack 40 and the cover sheet 41 are made into a finished product 50 by applying three staples 51 along a stitching line 42 parallel to the spine 43.

After stitching, the printed product 50 is trimmed on its three open edges if required.

Variants to the methods shown in FIG. 1 are e.g.:

The product parts of one product comprise different numbers of sheets and/or have different formats.

At least part of the product parts are not collated on-line but are e.g. fed into the collating line from rolls.

The product parts are at least partially produced from superimposed webs but by inserting or collecting sheets which are already folded or by collating unfolded sheets and folding them afterwards.

Additional products from other sources are collated between the product parts.

The product parts are submitted to an additional process before collating (e.g. application of an additional product such as a card or a sample bag or printing of individual information onto one of the outermost pages).

Stack 40 of product parts is not fitted or fitted in different manner with a cover sheet or a spine cover (see FIGS. 4 to 10).

The wire stitching is replaced by an equivalent method for connecting the product parts (e.g. sewing with thread).

Figure 2:
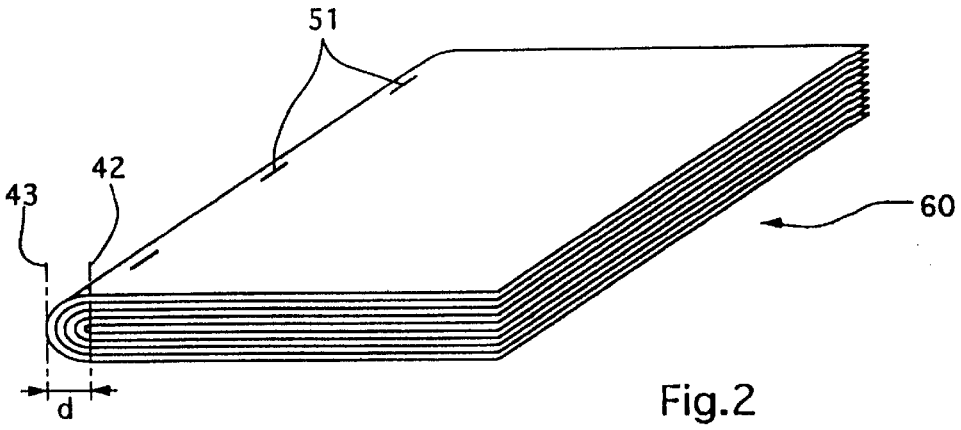
FIG. 2 is a schematic perspective view of a printed product produced according to the inventive method comprising of only one product part or of a plurality of product parts inserted inside each other or collected on top of each other.

FIG. 2 shows a printed product 60 which substantially consists of folded sheets and is produced according to the inventive method. The shown product only consists of one product part or it has been formed by collecting or inserting from a plurality of product parts, such that all sheets are folded inside each other.

It can be seen from FIG. 2 that the position of the stitching line 42 must have a distance d from the outermost spine edge 43 which distance is large enough for the innermost sheet of the product to be gripped and fixed by the stitching. In other words the distance between stitching line 42 and the outermost spine edge 43 must in each case be larger than half the thickness of the finished product.

Figure 3:
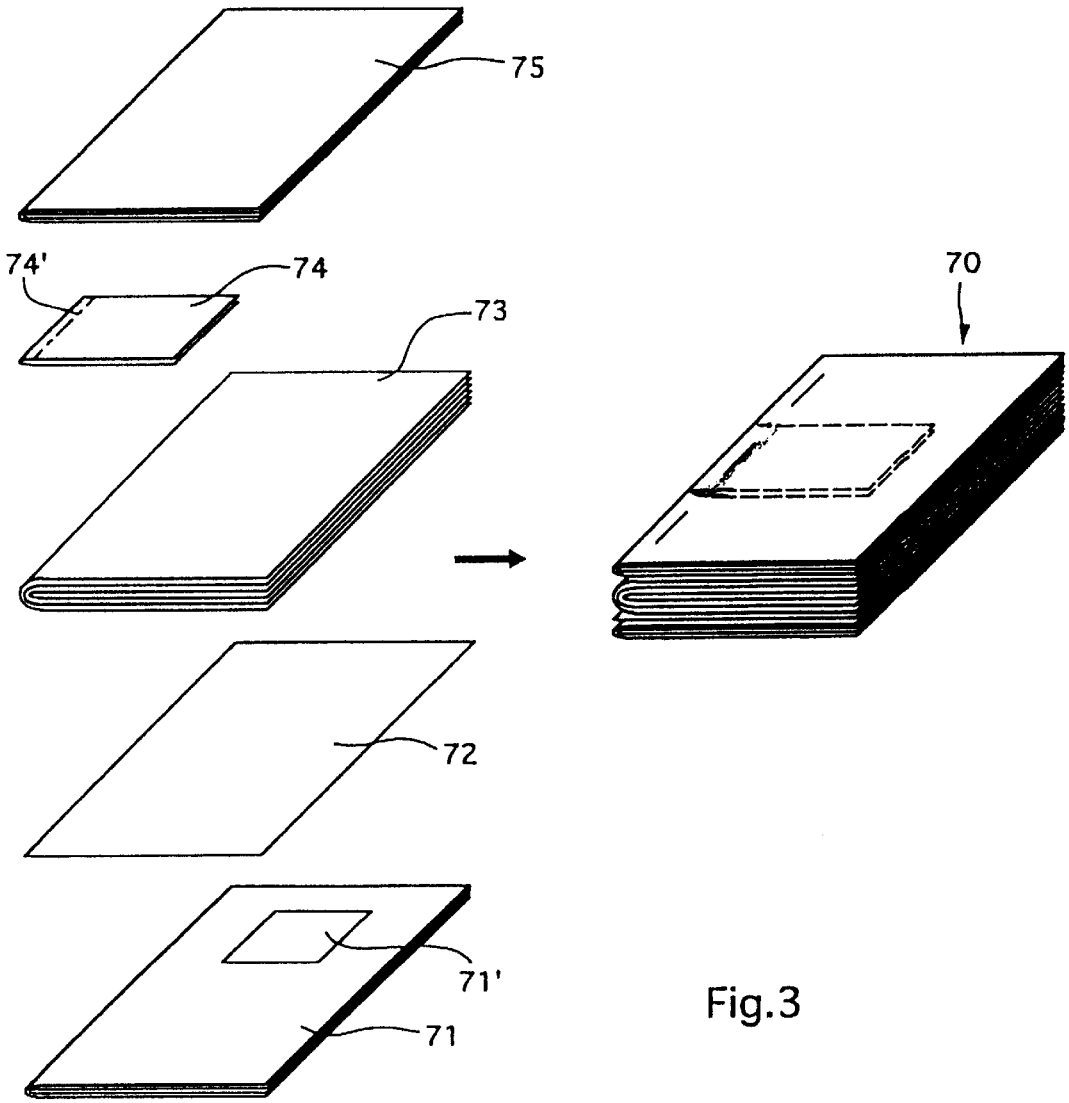
FIG. 3 is a schematic diagram of a further embodiment of the inventive method for producing a printed product by collating a plurality of product parts and additional products and FIGS. 4 to 10 are schematic perspective views further examples of printed products which are producible according to the inventive method.

FIG. 3 shows product parts and intermediate products 71 to 75 and a printed product 70 produced from them according to the inventive method. The shown product parts and additional products are:

a multi-leaf product part 71 consisting of a plurality of sheets folded inside each other which product part comprises a sample bag 71' glued to the side facing inward in the finished product, an additional product in form of a single, not folded sheet 72, a further, thicker multi-leaf product part 73, a product part consisting of only one folded sheet substantially of a card format and with a corresponding perforation line 74' and a last, thin multi-leaf product part 75.

Product 70 produced from the product parts and additional products 71 to 75 is again held together by three staples, whereby product part 74 with card format is positioned such that it is held by the middle staple. The distance between the stitching line and the spine must in any case be larger than half the thickness of the thickest product part (73).

It can be seen from FIG. 3 that the production of this kind of product allows a very high variation of components without making additional steps necessary. It can also be seen that when producing e.g. newspapers or advertising brochures according to the inventive method, most various, known additional products can be integrated into the printed product and most various additional processing of the product parts and additional products can be integrated into the method without having to adapt the collating step or the stitching step and without having to open the product parts or the finished product.

FIGS. 4 to 10 show different variants with which products produced according the inventive method can be fitted with cover sheets and/or spine covers.

Figure 4:
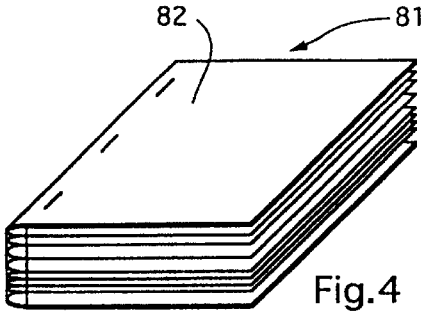

FIG. 4 shows a printed product 81 which consists of eight product parts of different thicknesses and which is fitted with a cover sheet 82 in a known manner, whereby the cover sheet 82 has a format which substantially corresponds to two pages of the finished product plus the width of the spine. The superimposed product parts and the cover sheet positioned around the product parts are connected to each other by means of stitching.

Figure 5:
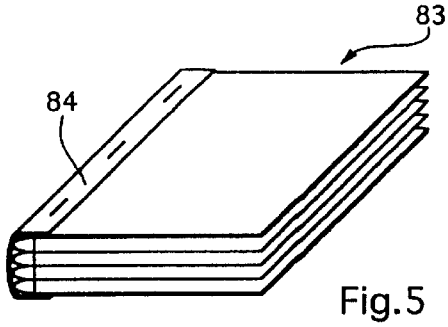

FIG. 5 shows a further exemplified printed product 83. This product differs from printed product 81 in FIG. 4 in that instead of a cover sheet a spine strip 84 is fitted which spine strip 84 has a width which is larger than the width of the spine plus twice the distance between the stitching line and the spine. This spine strip 84 must also be positioned on the spine before stitching and be fixed to the product with the stitching.

Figure 6:
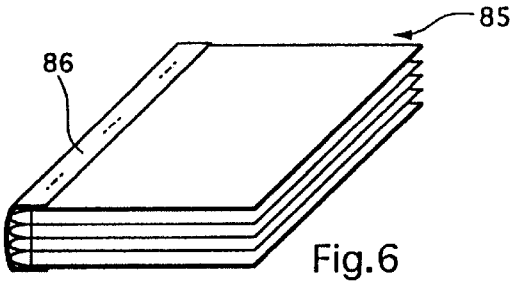

FIG. 6 shows a further printed product 85 which is also fitted with a spine strip 86, whereby this spine strip 86 is positioned on the product after stitching and thus covers the stitching which is a possibility for producing a product with a higher aesthetic value.

Figure 7:
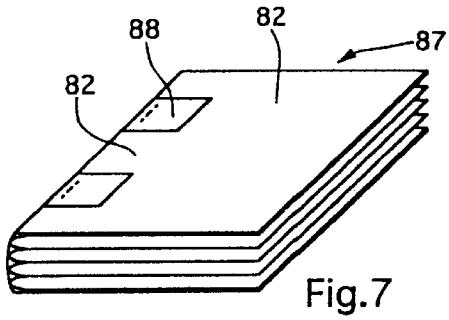

FIG. 7 shows a further printed product 87 which is, similar to the product 81 in FIG. 4, fitted with a cover sheet 82 connected to the product parts by the stitching, whereby the staples are covered by cover strips 88 which are e.g. glued on locally.

Figure 8:
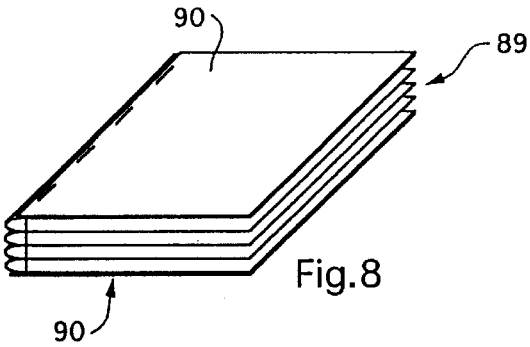

FIG. 8 shows a further printed product 89, which comprises two single cover leafs 90 which cover leafs 90 are e.g. collated first and last as additional products and are stitched together with the product parts. If the cover leafs 90 consist of a relatively stiff material it is advantageous to prefold them parallel to the stitching line (see also description of FIG. 10).

Figure 9:
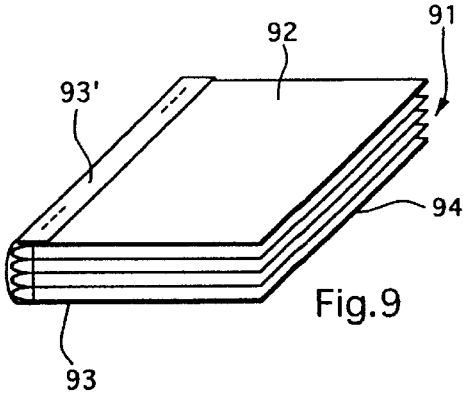

FIG. 9 shows a further printed product 91 which comprises a cover leaf 92 in the front or at the back respectively and a cover/spine leaf 93 at the back or in the front respectively, whereby the cover/spine leaf 93 has a format which is wider than one page of the printed product plus the width of the spine plus the distance between stitching line and spine. The cover leaf 92 and the cover/spine leaf 93 are e.g. collated together with the product parts, such that the front edges 94 of all the collated components are substantially superimposed and such that the spine area 93' of the cover/spine leaf 93 protrudes over the spine. Then the collated product parts together with the cover leaf 92 and the cover/spine leaf 93 are stitched and then the spine region 93' of the cover/spine leaf 93 is folded over the spine and glued over the stitching.

Figure 10:
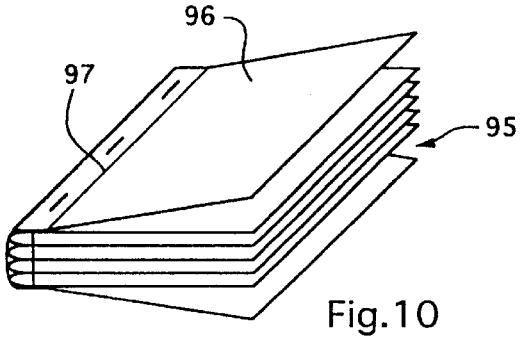

FIG. 10 shows a further printed product 95 with a cover sheet 96 e.g. made of stiff paper or cardboard which cover sheet is fixed to the product parts by the stitching. In order for the product to be easily openable and in order to prevent the cover sheet from being ripped, the cover sheet is prefolded parallel to the stitching line, whereby the folding line 97 has a larger distance from the spine of the product than the stitching line.

What is claimed is:

1. A method of binding a plurality of groups of sheets to form a product comprising the steps of forming groups of sheets folded inside each other, each group having an outermost sheet and an innermost sheet and each group having a folded edge, stacking said groups with the folded edges of the groups superimposed to form an unstitched group stack, adding to the group stack a cover sheet wherein the cover sheet covers the spine and front and back surfaces of the stack, and, in a single stitching step, stitching the group stack along a stitching line along each of the front and back surfaces of the stack, each stitching line being spaced a distance from the folded edges greater than the distance between the fold of the outermost sheet and the fold of the innermost sheet so that the stitching penetrates all sheets of the groups and attaches the added cover sheet to the group stack in the step of stitching.

2. A method according to claim 1 wherein the stitching is wire stitching comprising a plurality of staples.

3. A method according to claim 1 wherein said stitching comprises thread.

4. A method according to claim 1 wherein the step of forming groups of sheets includes inserting additional product parts into the folded sheets, and the step of stitching includes stitching the inserted additional product parts when the folded edges are stitched.

5. A method according to claim 4 wherein the additional product parts are individual sheets, folded or unfolded.

6. A method of binding a plurality of groups of sheets to form a product comprising the steps of forming groups of sheets folded inside each other, each group having an outermost sheet and an innermost sheet and each group having a folded edge, stacking said groups with the folded edges of the groups superimposed to form an unstitched group stack, adding to the group stack a cover sheet wherein the cover sheet covers the spine and front and back surfaces of the stack, forming a prefold line along the cover sheet, the prefold line being spaced from the folded edges a distance greater than the distance between the folded edges and the stitching line, and in a single stitching step, stitching the group stack along the stitching lines, each stitching line being spaced a distance from the folded edges greater than the distance between the fold of the outermost sheet and the fold of the innermost sheet so that the stitching penetrates all sheets of the groups and attaches the added cover sheet to the group stack in the step of stitching.

7. A method of binding a group of sheets to form a product comprising the steps of forming a group of sheets folded inside each other, the group having an outermost sheet and an innermost sheet and having a folded edge, providing a cover sheet wherein the cover sheet covers the spine and front and back surfaces of the group;

adding to the unstitched group an additional product and the cover sheet, and, in a single stitching step, stitching the group along the stitching line, the stitching line being spaced a distance from the folded edge greater than the distance between the fold of the outermost sheet and the fold of the innermost sheet so that the stitching penetrates all sheets of the group and the added cover sheet.

8. A printed product made by the method of binding a plurality of groups of sheets to form a product comprising the steps of forming groups of a plurality of sheets folded inside each other, each group having an outermost sheet and an innermost sheet and each group having a folded edge, stacking said groups with the folded edges of the groups superimposed to form an unstitched group stack, adding to the group stack at least one of a cover spine leaf and a cover sheet wherein the cover spine leaf is sufficiently wide to cover the spine of the stack and extend across lines for stitching on both sides of the spine parallel with the superimposed folded edges, and the cover sheet covers the spine and front and back surfaces of the stack, and, in a single stitching step, stitching the group stack along the stitching lines, each stitching line being spaced a distance from the folded edges greater than the distance between the fold of the outermost sheet and the fold of the innermost sheet so that the stitching penetrates all sheets of the groups and attaches the added cover spine leaf or cover sheet to the group stack in the step of stitching.

9. A printed product according to claim 8 and including at least one of an additional product, a cover sheet and a spine leaf wherein the cover spine leaf is sufficiently wide to cover the spine of the stack and extend across stitching lines on both sides of the spine parallel with the superimposed folded edges, and the cover sheet covers the spine and front and back surfaces of the stack.

* * * * *